US005517970A

United States Patent [19]

Okada et al.

[11] Patent Number: 5,517,970

[45] Date of Patent: May 21, 1996

[54] FUEL FEEDING SYSTEM AND METHOD FOR INTERNAL COMBUSTION ENGINE

[75] Inventors: Kojiro Okada, Nagoya; Shogo Omori, Okazaki, both of Japan

[73] Assignee: Mitsubishi Jidosha Kogyo Kabushiki Kaisha, Tokyo, Japan

[21] Appl. No.: 490,744

[22] Filed: Jun. 15, 1995

[30] Foreign Application Priority Data

Jun. 23, 1994 [JP] Japan ..... 6-141625
Jun. 23, 1994 [JP] Japan ..... 6-141626

[51] Int. Cl.[6] ..... F02D 41/04

[52] U.S. Cl. ..... 123/436

[58] Field of Search ..... 123/674, 675, 123/679, 682, 687, 436

[56] References Cited

U.S. PATENT DOCUMENTS

| | | | |
|---|---|---|---|
| 5,001,645 | 3/1991 | Williams et al. | 123/436 |
| 5,003,955 | 4/1991 | Haraguchi et al. | 123/675 |
| 5,016,591 | 5/1991 | Nanyoshi et al. | 123/436 |
| 5,086,741 | 2/1992 | Nakamura et al. | 123/436 |
| 5,241,840 | 8/1993 | Takaku et al. | 123/436 |
| 5,278,760 | 1/1994 | Ribbens et al. | 123/436 |
| 5,361,213 | 11/1994 | Furjieda et al. | 123/436 |
| 5,385,129 | 1/1995 | Eyberg | 123/436 |
| 5,447,137 | 9/1995 | Asano et al. | 123/436 |

FOREIGN PATENT DOCUMENTS 58-217732 12/1983 Japan .

*Primary Examiner*—Willis R. Wolfe

[57] ABSTRACT

A fuel feeding system according to this invention has a fuel injector capable of controlling the quantity of fuel to be fed to an internal combustion engine, a first detector for detecting a fluctuated state of combustion in the engine, a fuel feed controller for determining a quantity of fuel, which is to be fed from the fuel injector to maintain an air/fuel ratio of the engine at a value in the neighborhood of a lean combustion limit, on the basis of detection data from the first detector and controlling the fuel injector on the basis of the value of the thus-determined quantity of fuel, a second detector for detecting a state of operation of the engine, a control data updating unit for repeatedly updating the predetermined control data on the basis of the detection data when the engine has been detected to be in a first operation state by the second detector, and a control data holder for holding the control data at a value, to which the control data was updated in the immediately preceding first operation state, when the engine has been detected to be out of the first operation state by the second detector.

30 Claims, 6 Drawing Sheets

FUEL FEEDING SYSTEM AND METHOD FOR INTERNAL COMBUSTION ENGINE

BACKGROUND OF THE INVENTION

1. Field of the Invention

This invention relates to a fuel feeding system and method for an internal combustion engine, especially for a lean-burn internal combustion engine which performs a lean-burn operation at an air/fuel ratio on a side leaner than a stoichiometric air/fuel ratio under predetermined operation conditions.

2. Description of the Related Art

Lean-burn internal combustion engines (i.e., so-called lean-burn engines) have been provided in recent years, which perform a lean-burn operation at an air/fuel ratio on a side leaner than a stoichiometric air/fuel ratio under predetermined operation conditions.

In such lean-burn engines, the air/fuel ratio is set as high as possible (in other words, an air-fuel mixture is set as lean as possible) during a lean-burn operation so that the emission of NOx can be reduced. The value of the air/fuel ratio is generally set close to a limit within which the air-fuel mixture can undergo stable combustion (i.e., a lean limit).

By performing such a lean-burn operation, it is possible to significantly improve the gas mileage while suppressing the emission of NOx.

To perform a lean-burn operation, it is the common practice to control the state of combustion by a controller. It has been reported in articles and the like to estimate an engine torque from an angular acceleration of a crankshaft in such control.

Further, Japanese Patent Application Laid-Open (Kokai) No. SHO 58-217732, for example, discloses the technique that, when fluctuations in the revolution speed of an engine are small, the state of combustion is determined to be stable and the air/fuel ratio is hence controlled to a lean side but, when such fluctuations are large, the state of combustion is determined to be unstable and the air/fuel ratio is controlled to a rich side.

In the above-described technique that an engine torque is estimated from an angular acceleration of a crankshaft, estimation and control of the state of an engine are however performed moment by moment on the basis of varying momentary values. It has not been contemplated to perform stable and precise control at predetermined intervals while taking into consideration the probabilistic and statistical nature of engine torque.

On the other hand, the following problem arises when control is performed to permit leaner combustion while detecting the stability/instability of combustion like the technique of Japanese Patent Application Laid-Open (Kokai) No. SHO 58-217732.

Namely, learning of the state of combustion is effected in a lean burn operation zone. Assume that the state of operation of an engine has again entered the lean burn zone subsequent to departure from the lean burn operation zone. Any attempt to learn variations among cylinders from the beginning leads to the problem that no lean-burn operation at a combustion limit can be achieved until this learning is completed.

In an operation zone where fuel is injected, for example, in a relatively large quantity or in contrast, in a relatively small quantity, linearity may not be maintained with respect to the fuel injection characteristic of an injector in some instances. In such a case, detected data lack accuracy so that the leaning of the state of combustion, namely, the learning of fluctuations in revolutions cannot be conducted correctly, thereby making it impossible to perform precise control of the air/fuel ratio for achieving combustion at the lean limit. This may lead to unstable combustion beyond a combustion limit in some instances.

SUMMARY OF THE INVENTION

With the foregoing problems in view, the present invention has as a primary object thereof the provision of a fuel feeding apparatus and method for an internal combustion engine, which enables to promptly achieve a lean-burn operation at a combustion limit when the state of operation of an engine has entered a lean-burn operation zone and which also permits a lean-burn operation at a still leaner air/fuel ratio in the vicinity of the combustion limit while retaining stable combustion in a broad operation zone.

In one aspect of the present invention, there is thus provided a fuel feeding system for an internal combustion engine, said system having fuel feeding means capable of controlling the quantity of fuel to be fed, means for detecting a fluctuated state of combustion in said internal combustion engine, and fuel feed control means for determining a quantity of fuel, which is to be fed from said fuel feeding means to maintain an air/fuel ratio of said internal combustion engine at a value in the neighborhood of a lean combustion limit, according to predetermined control data on the basis of detection data from said combustion fluctuation detecting means and controlling said fuel feeding means on the basis of the value of the thus-determined quantity of fuel, characterized in that said system further comprises:

means for detecting a state of operation of said internal combustion engine;

control data updating means for repeatedly updating the predetermined control data on the basis of the detection data when said internal combustion engine has been detected to be in a first operation state by said operation state detection means; and control data holding means for holding the control data at a value, to which the control data was updated in the immediately preceding first operation state, when said internal combustion engine has been detected to be out of the first operation state by said operation state detecting means.

According to the fuel feeding system of the present invention, the fuel feed control means determines the quantity of fuel, which is to be fed from the fuel feeding means, so that the air/fuel ratio of the internal combustion engine is maintained at the value in the neighborhood of the lean combustion limit, and controls the fuel feeding means on the basis of the thus determined value. If the state of operation of the internal combustion engine is determined by the operation state detection means to be the first operation state defined inside the lean-burn operation zone, the control data for the determination of the quantity of fuel to be fed is repeatedly updated by the control data updating means on the basis of the detection data obtained by the combustion fluctuation detecting means. If the state of operation of the internal combustion engine is detected by the combustion fluctuation detecting means to be other than the first operation state, on the other hand, the control data is held by the control data holding means at the value to which the control data was updated in the immediately preceding first operation state. As a consequence, variations in the quantity of injected fuel are corrected, thereby bringing about the advantage that a lean-burn operation can be performed in the neighborhood of the combustion limit.

The control data holding means may desirously comprise means for determining latest control data on the basis of control data updated immediately before and the detection data. According to this construction, the control data in the preceding control is always reflected to the control data for the present control so that the quantity of fuel to be fed in the neighborhood of the combustion limit can be set optimally.

The first operation state may be defined by a quantity of inducted air and a revolution speed of said internal combustion engine. This makes it possible to obtain detection data of good accuracy corresponding to a load on the internal combustion engine, so that a lean-burn operation in the vicinity of the combustion limit can be stabilized.

The system may further comprise means for clipping the control data, which is held in said control data holding means, equal to or greater than a predetermined value which can achieve a stable lean-burn operation. As a result, the operation in the lean-burn operation zone is stabilized so that the drivability can be improved.

The system may further comprise means for setting the air/fuel ratio on a side richer than the value in the neighborhood of the lean combustion limit in an operation state other than the first operation state. According to this construction, the air/fuel ratio becomes richer than the value in the neighborhood of the lean combustion limit in the operation state other than the first operation state, thereby making it possible to avoid misfiring or the like and to improve the drivability.

The system may further comprise means for determining the quantity of fuel, which is to be fed, on the basis of the control data held in the control data holding means when said internal combustion engine has returned again into the first operation state subsequent to departure from the first operation state. Accordingly, when the state of operation of the internal combustion engine returns to the first operation state, the quantity of fuel to be fed is set again using the control data which has been learnt during the operation immediately before the departure from the first operation state. It is therefore unnecessary to learn variations among cylinders again from the beginning, thereby making it possible to promptly move to a state where a lean-burn operation is controlled at the combustion limit.

The system may further comprise means for setting, in an operation state other than the first operation state, the air/fuel ratio at a lean air/fuel ratio on the basis of the control date held in said control data holding means. Even if control data cannot be accurately calculated, it is still possible to achieve a smooth lean-burn operation by using accurate data which was obtained in the past.

The system may further comprise means for setting the air/fuel ratio at a lean air/fuel ratio on the basis of the held control data in a second operation state other than the first operation state but at an air/fuel ratio on a side richer than the lean air/fuel ratio in a third operation state other than the first operation state and the second operation state. Even if control data cannot be accurately calculated in the second operation state, it is also possible to achieve a smooth lean-burn operation by using accurate data which was obtained in the past. Moreover, in the third operation state outside the lean-burn operation zone, the air/fuel ratio is set on the richer side so that the drivability can be improved.

The data holding means may comprise means for also holding the control data during stoppage of said internal combustion engine. According to this construction, it is still possible, even upon restarting the internal combustion engine, to promptly move to a state in which a lean-burn operation is controlled at the combustion limit.

The internal combustion engine may have plural cylinders, the plural cylinders may each be provided with said combustion fluctuation detecting means, said control data updating means and said control data holding means, and said fuel feeding means may comprise means for determining, on the basis of control data on the individual cylinders, quantities of fuel to be fed to the individual cylinders, respectively. This allows to correct the quantity of fuel to be fed to each of the cylinders and hence to perform fine control of the internal combustion engine.

Further, the combustion fluctuation detecting means may comprise means for detecting as fluctuated combustion data of said internal combustion engine a fluctuated value in angular acceleration of a rotary shaft driven by said internal combustion engine and means for determining a normalized fluctuation value by normalizing the fluctuated value in accordance with a state of operation of said internal combustion engine, the system may further comprise means for calculating a deteriorated combustion determination value by comparing the normalized fluctuation value, which has been obtained by said normalized fluctuation value determination means, with a predetermined threshold, said fuel feed control means further comprises means for modifying one of the fluctuated value and the threshold depending on the state of operation of said internal combustion engine, and the control data updating means may comprise means for calculating the control data so that the deteriorated combustion determination value approaches a predetermined base value. Owing to this construction, the fluctuated value in the angular acceleration of the rotary shaft driven by the internal combustion engine is detected as fluctuated data of the internal combustion engine by the angular acceleration fluctuation detecting means and by the normalized fluctuated value detection means, the fluctuated value is normalized in accordance with the state of operation of the internal combustion engine and the normalized fluctuated value is calculated. In addition, by the deteriorated combustion determination value calculating means, the normalized fluctuated value obtained by the normalized fluctuated value detection means is compared with the predetermined threshold to determine the deteriorated combustion determination value. Further, at the control data updating means, the control data is calculated based on these data so that the deteriorated combustion determination value approaches the predetermined base value. The state of combustion is therefore controlled corresponding to the state of operation of the internal combustion engine, thereby making it possible to perform an operation at the lean burn limit in a broader operation zone.

In another aspect of the present invention, there is also provided a fuel feeding method for an internal combustion engine, said method including determining a quantity of fuel, which is to be fed from fuel feeding means to maintain an air/fuel ratio of an internal combustion engine at a value in the neighborhood of a lean combustion limit, according to predetermined control data and controlling said fuel feeding means on the basis of the value of the thus-determined quantity of fuel, characterized in that said method comprises the following steps:

detecting a fluctuated combustion state of said internal combustion engine;

repeatedly updating the predetermined control data on the basis of the detection data in said fluctuated combustion state detection step when said internal combustion engine has been detected to be in a first operation state in said fluctuated combustion state detection step; and holding the control data at a value, to which the control data was updated in the immediately preceding first operation state, when said internal combustion engine has been detected to be out of the first operation state by said fluctuated combustion state detection step.

When the internal combustion engine is detected to be in the first operation sate on the basis of the fluctuated combustion state in the fluctuated combustion detection step, the control data for the determination of the quantity of fuel to be fed is repeatedly updated in the control data updating step on the basis of the data detected in the fluctuated combustion detection step. When the internal combustion engine is detected to be outside the first operation state by the fluctuated combustion detection means, the control data is held at the value, to which the control data was updated in the immediately preceding first operation state, in the control data holding step. Variations in the quantity of injected fuel are therefore corrected, thereby making it possible to perform a lean-burn operation in the neighborhood of the combustion limit.

The control data updating step may comprise determining latest control data on the basis of control data updated immediately before and the detection data. According to this construction, the preceding control data can always be reflected to the present control data in the control data updating step so that the quantity of fuel to be fed in the vicinity of the combustion limit can be optimally set.

The first operation state may be defined by a quantity of inducted air and a revolution speed of said internal combustion engine. This makes it possible to obtain detection data of good accuracy corresponding to a load on the internal combustion engine, so that a lean-burn operation in the vicinity of the combustion limit can be stabilized.

The method may further comprise clipping the control data, which is held in said control data holding means, equal to or greater than a predetermined value which can achieve a stable lean-burn operation. As a result, the operation in the lean-burn operation zone is stabilized so that the drivability can be improved.

The method may further comprise setting the air/fuel ratio on a side richer than the value in the neighborhood of the lean combustion limit in an operation state other than the first operation state. According to this construction, the air/fuel ratio becomes richer than the value in the neighborhood of the lean combustion limit in the operation state other than the first operation state, thereby making it possible to avoid misfiring or the like and to improve the drivability.

The method may further comprise determining the quantity of fuel, which is to be fed, on the basis of the control data held in the control data holding step when said internal combustion engine has returned again into the first operation state subsequent to departure from the first operation state. Accordingly, when the state of operation of the internal combustion engine returns to the first operation state, the quantity of fuel to be fed is set again using the control data which has been learnt during the operation immediately before the departure from the first operation state. It is therefore unnecessary to learn variations among cylinders again from the beginning, thereby making it possible to promptly move to a state where a lean-burn operation is controlled at the combustion limit.

The method may further comprise setting, in an operation state other than the first operation state, the air/fuel ratio at a lean air/fuel ratio on the basis of the control date held in said control data holding step. Even if control data cannot be accurately calculated, it is still possible to achieve a smooth lean-burn operation by using accurate data which was obtained in the control data holding step in the past.

The first operation state may be defined by a quantity of inducted air and a revolution speed of said internal combustion engine. This makes it possible to obtain detection data of good accuracy corresponding to a load on the internal combustion engine, so that a lean-burn operation in the vicinity of the combustion limit can be stabilized.

The method may further comprise clipping the control data, which is held in said control data holding means, equal to or greater than a predetermined value which can achieve a stable lean-burn operation. As a result, the operation in the lean-burn operation zone is stabilized so that the drivability can be improved.

The method may further comprise setting the air/fuel ratio at a lean air/fuel ratio on the basis of the held control data in a second operation state other than the first operation state but at an air/fuel ratio on a side richer than the lean air/fuel ratio in a third operation state other than the first operation state and the second operation state. Even if control data cannot be accurately calculated in the second operation state, it is also possible to achieve a smooth lean-burn operation by using accurate data which was obtained in the past. Moreover, in the third operation state outside the lean-burn operation zone, the air/fuel ratio is set on the richer side so that the drivability can be improved.

The data holding step may comprise also holding the control data during stoppage of said internal combustion engine. According to this construction, it is still possible, even upon restarting the internal combustion engine, to promptly move to a state in which a lean-burn operation is controlled at the combustion limit.

The fluctuated combustion state detecting step may comprise an angular acceleration fluctuation detecting step for detecting as fluctuated combustion data of said internal combustion engine a fluctuated value in angular acceleration of a rotary shaft driven by said internal combustion engine and a normalized fluctuation value detection step for determining a normalized fluctuation value by normalizing the fluctuated value in accordance with a state of operation of said internal combustion engine; said method may further comprise a deteriorated combustion determination value calculating step for calculating a deteriorated combustion determination value by comparing the normalized fluctuation value, which has been obtained in said normalized fluctuation value determination step, with a predetermined threshold, and a step for modifying one of the fluctuated value and the threshold depending on the state of operation of said internal combustion engine (1); and said control data updating step may comprise calculating the control data so that the deteriorated combustion determination value approaches a predetermined base value. Owing to this construction, the fluctuated value in the angular acceleration of the rotary shaft driven by the internal combustion engine is detected as fluctuated data of the internal combustion engine by the angular acceleration fluctuation detecting means and by the normalized fluctuated value detection means, the fluctuated value is normalized in accordance with the state of operation of the internal combustion engine and the normalized fluctuated value is calculated. In addition, by the deteriorated combustion determination value calculating means, the normalized fluctuated value obtained by the normalized fluctuated value detection means is compared with the predetermined threshold to determine the deteriorated combustion determination value. Further, at the control data updating means, the control data is calculated based on these data so that the deteriorated combustion determination value approaches the predetermined base value. The state of combustion is therefore controlled corresponding to the state of operation of the internal combustion engine, thereby making it possible to perform an operation at the lean combustion limit in a broader operation zone.

DETAILED DESCRIPTION OF THE INVENTION AND PREFERRED EMBODIMENT

With reference to the accompanying drawings, a fuel feeding system and method for an internal combustion engine will hereinafter be described as one embodiment of the present invention.

Figure 2:
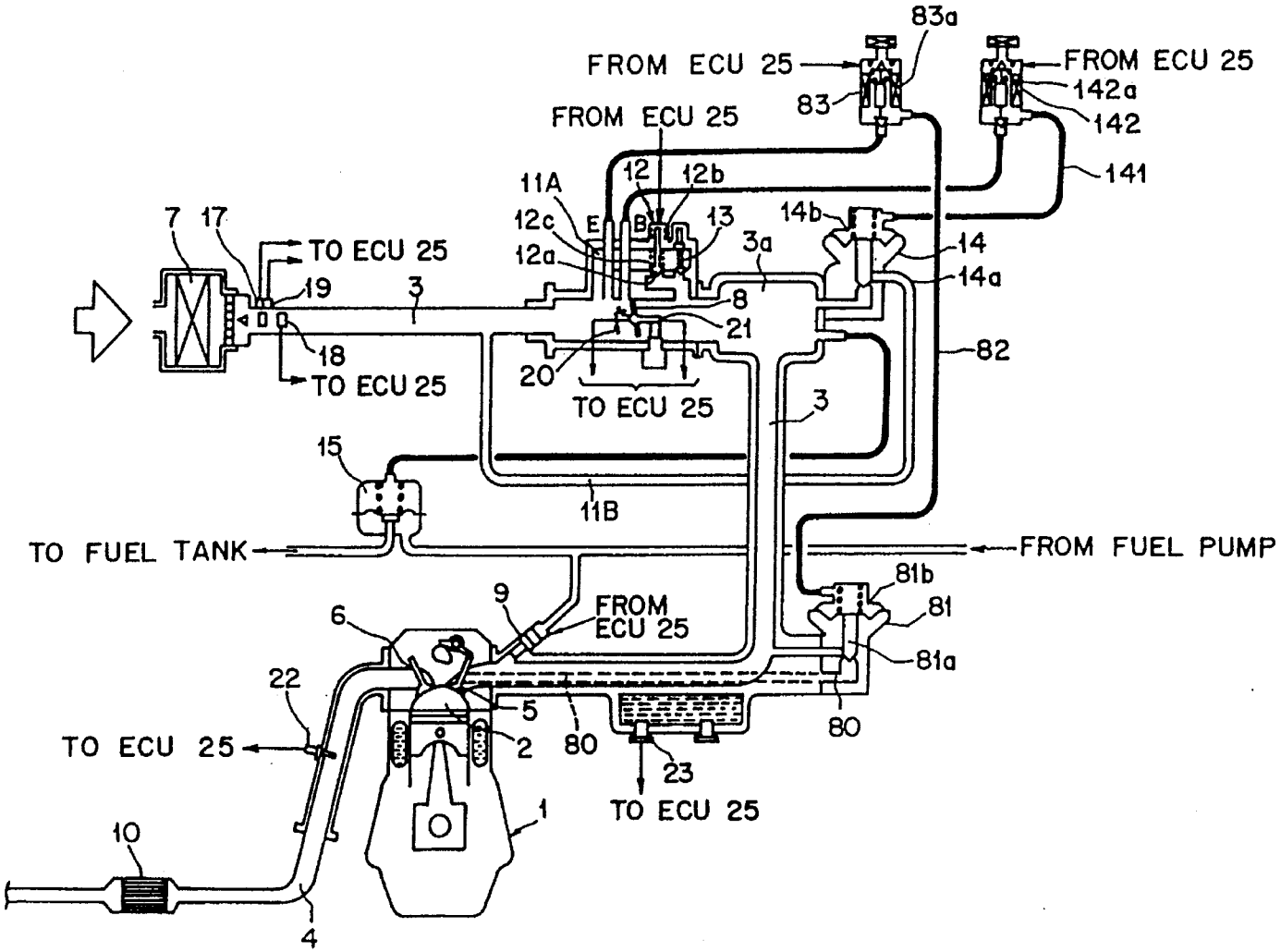
FIG. 2 is an overall construction diagram of an engine system equipped with the fuel feeding system of the present invention for the lean-burn internal combustion engine.

An engine for an automotive vehicle, said engine being equipped with the present control system, is constructed as a lean-burn engine which performs a lean-burn operation at an air/fuel ratio leaner than a stoichiometric air/fuel ration under predetermined operation conditions. This engine may be illustrated as shown in FIG. 2. In FIG. 2, the (internal combustion) engine which is designated at numeral 1 has an intake passage 3 and an exhaust passage 4, both of which are communicated to a combustion chamber 2. The communication between the intake passage 3 and the combustion chamber 2 is controlled by an intake valve 5, while the communication between the exhaust passage 4 and the combustion chamber 2 is controlled by an exhaust valve 6.

The intake passage 3 is provided with an air cleaner 7, a throttle valve 8 and as fuel feeding means, an electromagnetic fuel injection valve (injector) 9, which are arranged successively from an upstream side of the intake passage 3. The exhaust passage 4, on the other hand, is provided with a three-way catalyst 10 and an unillustrated muffler (noise eliminator) successively from an upstream side of the exhaust passage 4. Incidentally, each cylinder of the engine 1 is provided with its own injector 9. Further, the exhaust passage 3 is provided with a surge tank 3*a*.

The three-way catalyst 10 is to eliminate CO, HC and NOx while the engine is operated at the stoichiometric air/fuel ratio, and is of a known construction.

The throttle valve 8 is connected to an accelerator pedal (not shown) via a wire cable so that the position of the throttle valve 8 is regulated according to the stroke of the accelerator pedal.

The intake passage 3 is provided with a first bypass passage 11A which extends bypassing the throttle valve 8. Inserted in this bypass passage 11A is a stepper motor valve (hereinafter called the "STM valve") 12 which functions as an ISC (idling speed control) valve. In the first bypass passage 11A, a first idling air valve 13 of the wax type whose opening is regulated according to the temperature of an engine coolant is also arranged in a side-by-side relationship with the STM valve 12.

The STEM valve 12 is constructed of a valve element 12*a* which can be brought into contact with a valve seat portion formed in the first bypass passage 11A, a stepper motor (ISC actuator) 12*b* for controlling the position of the valve element, and a spring 12*c* normally biasing the valve element against the valve seat portion(i.e., in the direction that the first bypass passage 11A is closed by the valve element).

By adjusting the position of the valve element 12*a* stepwise (according to the number of steps) relative to the valve seat portion by the stepper motor 12*b*, the opening between the valve seat portion and the valve element 12*a*, that is, the position of the STM valve 12 can be controlled.

By controlling the position of the STM valve 12 in accordance with an electronic control unit (ECU) 25 as a controller, which will be described subsequently herein, intake air can be fed to the engine 1 through the first bypass passage 11A irrespective of operation of the accelerator pedal by the driver. By changing the position of the STM valve 12, the quantity of air to be inducted through the throttle bypass passage 11A can be controlled.

As an ISC actuator, a DC motor can also be used instead of the stepper motor 12*b*.

The intake passage 3 is additionally provided with a second bypass passage 11B which also extends bypassing the throttle valve 8. An air bypass valve 14 is inserted in the second bypass passage 11B.

The air bypass valve 14 is constructed of a valve element 14*a* which can be brought into contact with a valve seat portion formed in the second bypass passage 11B and a diaphragm-type actuator 14*b* for controlling the position of the valve element 14*a*. Connected to a diaphragm compartment of the diaphragm-type actuator 14*b* is a pilot passage 141 which is in communication with the intake passage 3 on a side upstream the throttle valve 8. An air-bypass-valve-controlling electromagnetic valve 142 is inserted in the pilot passage 141.

By controlling the position of the air-bypass-valve-controlling electromagnetic valve 142 with ECU 25 which will be described subsequently herein, it is also possible to supply intake air into the engine 1 through the second bypass passage lib irrespective of an operation of the accelerator pedal by the driver. Further, the quantity of air to be inducted while bypassing the throttle valve 8 can be controlled by changing the position of the air-bypass-valve-controlling electromagnetic valve 142. Incidentally, it is the basic mode of operation of the air-bypass-valve-controlling electromagnetic valve 142 that it is open in a lean-burn operation but is otherwise kept closed.

Between the exhaust passage 4 and the intake passage 3, an exhaust gas recirculation passage (EGR passage) 80 is inserted to return exhaust gas to the intake system. An EGR valve 81 is inserted in the EGR passage 80.

The EGR valve 81 is constructed of a valve element 81*a* which can be brought into contact with a valve seat portion formed in the EGR passage 80 and a diaphragm-type actuator 81*b* for controlling the position of the valve element 81a. Connected to a diaphragm compartment of the diaphragm-type actuator 81*b* is a pilot passage 82 which is in communication with the intake passage 3 on a side upstream the throttle valve 8. An EGR-valve-controlling electromagnetic valve 83 is inserted in the pilot passage 82.

By controlling the position of the EGR-valve-controlling electromagnetic valve 83 with ECU 25 which will be described subsequently herein, exhaust gas can be returned to the intake system through the EGR passage 80.

In FIG. 2, numeral 15 indicates a fuel pressure regulator. This fuel pressure regulator 15 is actuated responsive to a negative pressure in the intake passage 3 to control the quantity of fuel to be returned from an unillustrated fuel pump to an unillustrated fuel tank, so that the pressure of fuel to be injected from the injector 9 can be controlled.

To control the engine system, various sensors are arranged. First, as is shown in FIG. 2, a portion where intake air flowed past the air cleaner 7 flows into the intake passage 3 is provided with an air flow sensor (inducted air quantity sensor) 17 for detecting the quantity of the inducted air from Karman vortex information, an intake air temperature sensor 18 as inducted air temperature parameter detection means, and an atmospheric pressure sensor 19.

This intake air temperature sensor 18 is arranged to detect the temperature of intake air of the engine 1.

At the position of arrangement of the throttle valve 8 in the intake passage 3, there are arranged a throttle position sensor 20 in the form of a potentiometer for detecting the position of the throttle valve 8 as well as an idling switch 21.

On the side of the exhaust passage 4, on the other hand, an oxygen concentration sensor (hereinafter referred to simply as the "$O_2$ sensor") 22 for detecting the concentration of oxygen ($O_2$ concentration) in the exhaust gas is disposed. Other sensors include a coolant temperature sensor 23 for detecting the 10 temperature of coolant of the engine 1, a crank angle sensor 24 (see FIG. 3) for detecting a crank angle (which can also function as a speed sensor for detecting an engine speed Ne), a vehicle speed sensor 30, etc.

Figure 3:
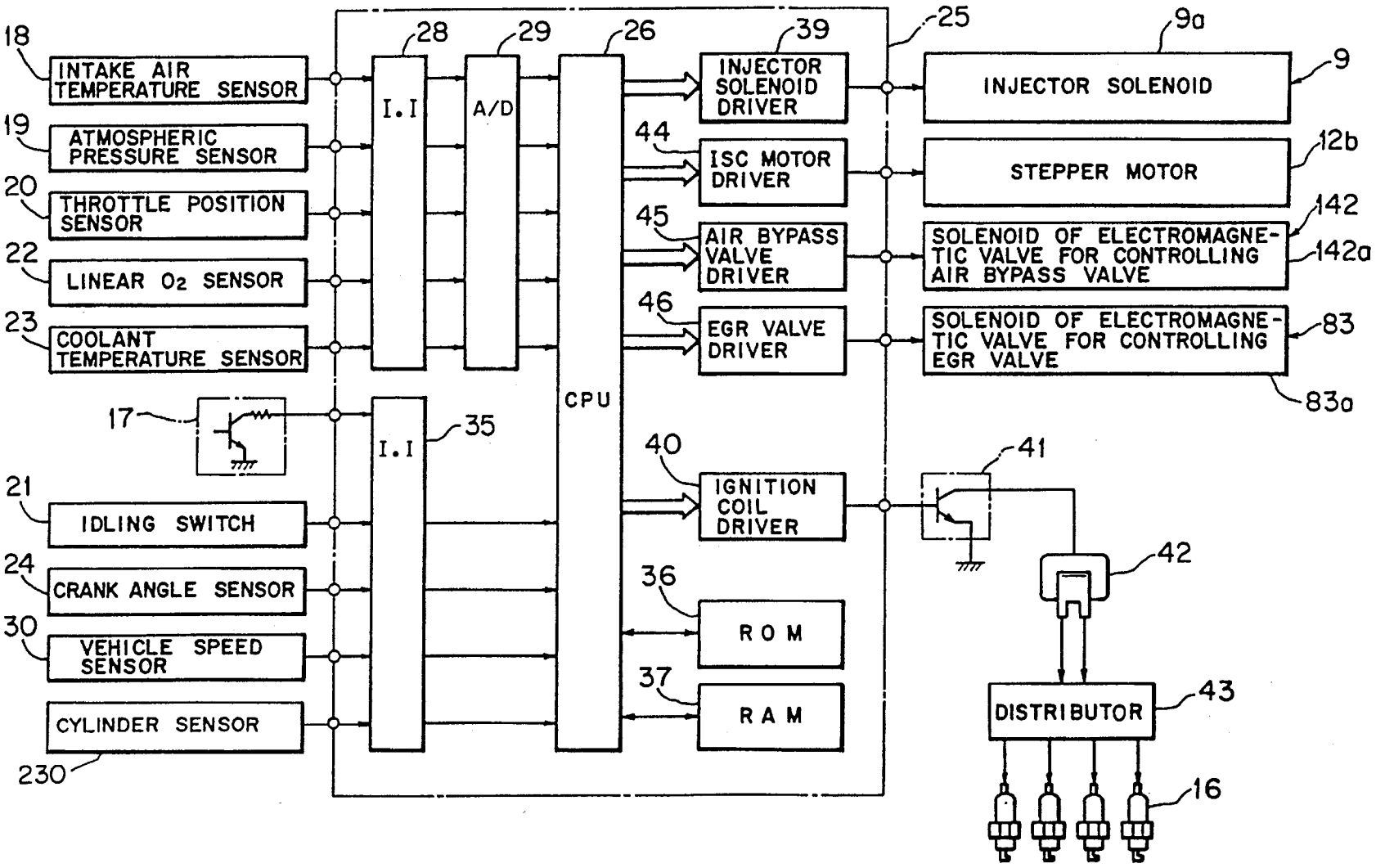
FIG. 3 is a hardware block diagram illustrating a control equipment of an engine system, in which the fuel feeding system of this invention for the internal combustion engine has been incorporated.

Detection signals from these sensors and switch are inputted to ECU 25 as shown in FIG. 3.

The hardware construction of ECU 25 can be illustrated as shown in FIG. 3. ECU 25 is constructed as a computer which is provided as a principal component thereof with CPU (processor) 26. To CPU 26, detection signals from the intake air temperature sensor 18, the atmospheric pressure sensor 19, the throttle position sensor 20, the 02 sensor 22, the coolant temperature sensor 23 and the like are inputted via an input interface (I.I) 28 and an A/D converter 29.

Directly inputted through an input interface (I.I) 35 to CPU 26 are detection signals from the air flow sensor 17, the idling switch 21, the crank angle sensor 24, the vehicle speed sensor 30 and the like.

Through a bus line, CPU 26 also exchanges data with ROM (memory means) 36, in which various data are stored along with program data and fixed value data, and also with RAM 37 which is updated, that is, successively rewritten.

As a result of computation by CPU 26, ECU 25 outputs signals for controlling the state of operation of the engine 1, for example, various control signals such as a fuel injection control signal, an ignition timing control signal, an ISC control signal, a bypass air control signal and an EGR control signal.

Here, the fuel injection control (air/fuel ratio control) signal is outputted from CPU 26 to an injector solenoid 9*a* (precisely, a transistor for the injector solenoid 9*a*), which is arranged to drive the injector 9, via an injector solenoid driver 39. The ignition timing control signal is outputted from CPU 26 to a power transistor 41 via an ignition coil driver 40, so that a current is supplied from the power transistor 41 via an ignition coil 42 to a distributor 43 to make individual spark plugs 16 successively produce sparks.

The ISC control signal is outputted from CPU 26 to the stepper motor 12*b* via the motor driver 44, while the bypass air control signal is outputted from CPU 26 to the solenoid 142*a* of the air-bypass-valve-controlling electromagnetic valve 142 via an air bypass valve driver 45.

Further, the EGR control signal is outputted from CPU 26 to the solenoid 83*a* of the EGR-valve-controlling electromagnetic valve 83 via the EGR driver 46.

Figure 1:
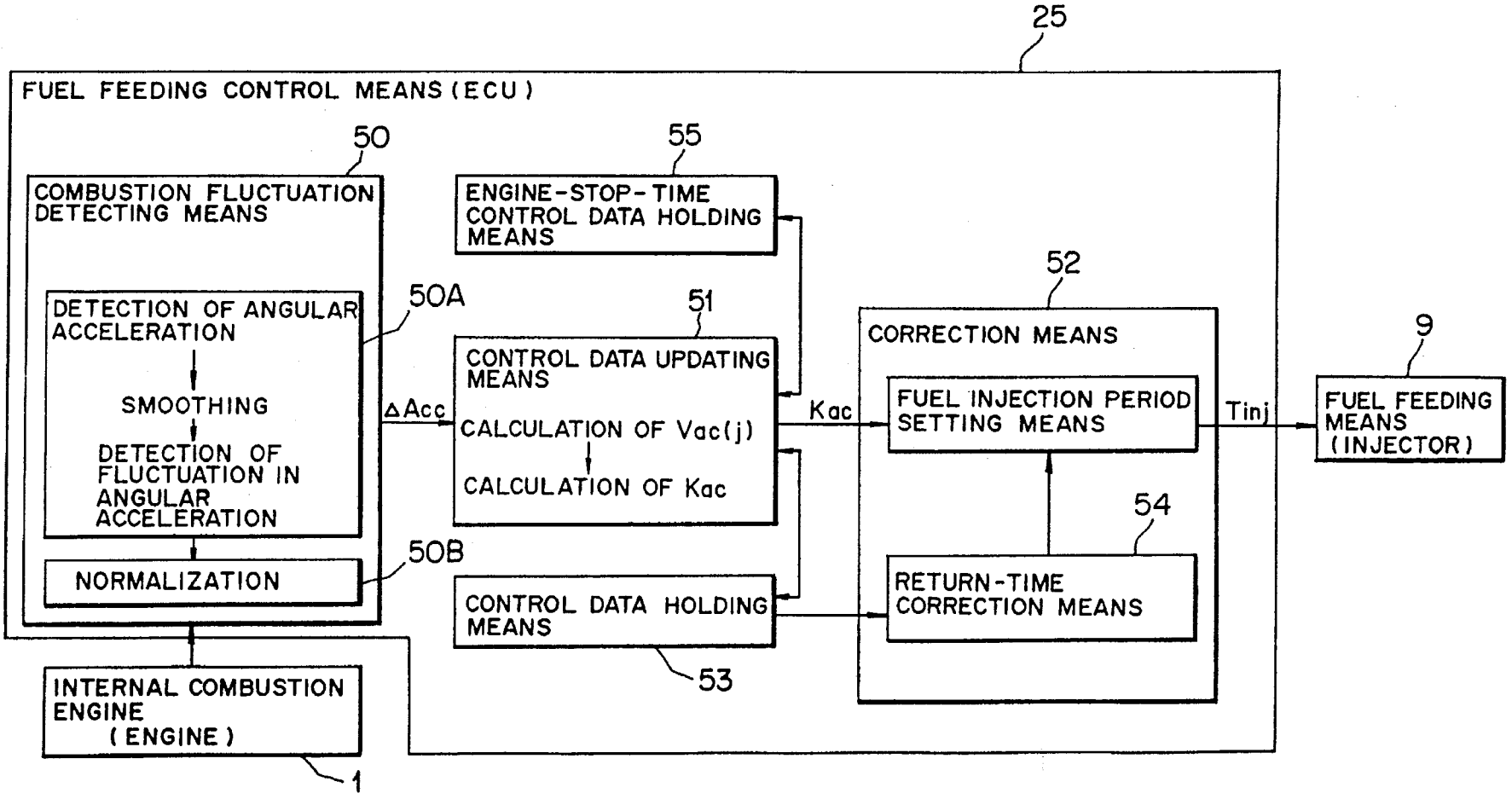
FIG. 1 is a schematic control block diagram showing the construction of a fuel feeding system of the present invention for a lean-burn internal combustion engine.

Now paying attention to a function for performing fuel injection control of the engine 1, ECU 25 is provided with combustion fluctuation detecting means 50, control data updating means 51 and correction means 52 as illustrated in FIG. 1, so that the fuel injection control (control of an injector drive period) is performed.

The combustion fluctuation detecting means 50 is arranged to detect fluctuations in combustion in the engine 1. At the control data updating means 51, control data (or a correction coefficient) for the correction of the fuel injection period is calculated and updated based on information on the operation of the engine from the combustion fluctuation detecting means 50. The correction means 52 serves to correct the fuel injection period by using a correction value calculated by the control data updating means 51.

The combustion fluctuation detecting means 50, the control data updating means 51 and the correction means 52 will hereinafter be described in detail. The combustion fluctuation detecting means 50 detects every fluctuated state of combustion in the engine 1 during a lean-burn operation, and is composed of angular acceleration fluctuation detecting means 50A for detecting every fluctuated value in the angular acceleration of the crankshaft as combustion fluctuation data of the engine 1 and normalized fluctuated value detecting means 50B for normalizing the fluctuated value in accordance with the state of operation of the internal combustion engine to determine a normalized fluctuated value.

At the angular acceleration fluctuation detecting means 50A, an angular acceleration Acc is detected by the crank angle sensor 24. By determining a difference ΔAcc between a smoothed value AccAV, which has been obtained by smoothing (averaging) the angular acceleration Acc, and the angular acceleration Acc outputted from the crank angle sensor 24, the state of fluctuation in the combustion in the engine is detected.

Namely, at the combustion fluctuation detecting means 50, a fluctuated acceleration value ΔAcc(n) is calculated by the following formula.

$$\alpha Acc(n)=Acc(n)-AccAV(n)$$

Incidentally, the suffix (n) in the above formula means that the cycle is the nth (present) igniting operation in a given cylinder.

Further, AccAV(n) is calculated by conducting primary filtering processing in accordance with the following formula:

$$AccAV(n)=\alpha.AccAV(n-1)+(1-\alpha).Acc(n)$$

where $\alpha$ is an updating gain in the primary filtering processing.

At the combustion fluctuation detecting means 50, the fluctuated value $\Delta Acc(n)$ is normalized according to the state of operation of the engine by the normalized fluctuated value detection means 50B, and the normalized fluctuated value IAC(n) is calculated in accordance with the following formula:

$$IAC(n)=\Delta Acc(n).Kte(Ev,Ne)$$

where Kte(Ev,Ne) is an output correction coefficient which is set based on the volumetric efficiency Ev of air to be inducted and an engine speed Ne calculated from a detection signal of the crank angle sensor 24 or the like, and is set using an output correction coefficient characteristic map (not illustrated) stored in ECU 25.

The state of every fluctuation in the combustion in the engine 1 is detected by the combustion fluctuation detecting means 50 as described above.

The control data updating means 51, on the other hand, calculates and updates a correction coefficient Kac on the basis of plural detection data [for example, data such as $\Delta Acc(n)$ and IAC(n) mentioned above] so that the state of combustion in the engine can approach the lean limit during a lean-burn operation.

At the control data updating means 51, the normalized fluctuated value IAC(n) is first compared with a predetermined threshold IACTH to determine a deteriorated combustion determination value Vac and the number of combustion-deteriorated cycles (hereinafter called the "combustion-deteriorated cycle number) Ndet. This deteriorated combustion determination value Vac is determined by cumulating the quantity of deterioration by which each normalized deteriorated value IAC(n) is smaller than the predetermined threshold IACTH and is calculated in accordance with the following formula:

$$Vac(j)=\Sigma\{IAC(j)<IACTH)\}.\{IACTH-IAC(j)\}$$

In the above formula, (IAC(j)<IACTH) is a function which stands for "1" when IAC(j)<IACTH is met but for "0" when this condition is not met. When each normalized fluctuated value IAC(n) is smaller than the predetermined threshold IACTH, the difference is cumulated as the quantity of deterioration.

Accordingly, the deteriorated combustion determination value Vac(j) is obtained by cumulating each quantity of deterioration which reflects the difference between the threshold value IACTH and the normalized fluctuated value IAC(j), so that effects of values around the threshold can be minimized to precisely reflect the state of deterioration.

Incidentally, letter "j" indicates a given cylinder of the engine and for example, a value to which this "j" is attached corresponds to a cylinder number or the like.

The combustion-deteriorated cycle number Ndet(j) is the number of cycles in which the state of combustion in the corresponding cylinder was determined to be deteriorated based on detection information from the combustion fluctuation detecting means 50, is the number of combustion-deteriorated cycles within preset control cycles, for example, 128 (or 256 cycles), and is expressed by the following formula:

$$Ndet(j)=\Sigma\{IAC(j)<IACTH\}$$

A description will next be made in detail of the calculation of the correction coefficient Kac. The correction coefficient Kac is calculated for each cylinder on the basis of the deteriorated cycle number Ndet(j) of the corresponding cylinder. By comparing the magnitude of the deteriorated cycle number Ndet(j) for that cylinder with two thresholds (a leaning-determining deteriorated cycle number N1 and an enrichment-determining deteriorated cycle number N2), the correction coefficient Kac is calculated by dividing the situation into the following three cases (1) to (3):

(1) When Ndet≧N2:

In this case, the correction coefficient Kac is set in accordance with the following formula so that the air/fuel ratio is modified richer.

$$Kac(j)=Kac(j-1)+Kar(Vac-Vaco)$$

(2) When N1≦Ndet<N2:

In this case, the correction coefficient Kac is set in accordance with the following formula so that the air/fuel ratio is maintained (held) at the same level.

$$Kac(j)=Kac(j-1)$$

(3) When Ndet<N1:

In this case, the correction coefficient Kac is set in accordance with the following formula so that the air/fuel ratio is modified leaner.

$$Kac(j)=Kac(J-1)+Kal(\text{Vaco-Vac})$$

In the above formulae (1) to (3), Kar means an enrichment gain, Kal a leaning gain, and Vaco a permissible variation of cumulative deterioration in acceleration. This permissible variation Vaco of cumulative deterioration in acceleration is a value corresponding to a target value (10% or so) of COV (coefficient of variance). By preventing any fuel correction within the range of $\Delta Vac$ on both sides of the permissible variation Vaco of cumulative deterioration in acceleration, it is possible to avoid occurrence of an error which would otherwise be caused by the evaluation of revolutional fluctuations within the limited period (128 cycles) or by computation based on a value smaller than the threshold.

The deteriorated combustion determination value Vac is updated per a preset number of combustions, for example, every 128th (or 256th) cycle. By conducting the control while ascertaining the state of combustion over a relatively long period, the control can be performed in a stable and accurate manner in which statistical characteristics are reflected.

Upon computation of (Vac-Vaco) upon enriching correction and (Vaco-Vac) upon leaning correction, their lower limits are clipped at 0.

The above-described correction coefficient Kac(j) is designed to be clipped at both upper and lower limits and is set to fall, for example, within the range of from 0.9 to 1.1 (exclusive), that is, to meet the following inequality: 0.9<Kac(j)<1.1. The correction coefficient Kac(j) is therefore set to avoid any abrupt correction and to gradually perform a correction so that occurrence of a shock or the like can be prevented and the control can be performed stably.

Subsequent to the calculation of the correction coefficient Kac at the control data updating means 51 as described above for making the state of combustion in the engine approach the lean limit during the lean-burn operation, a fuel injection period Tinj is then set at the correction means 52.

The fuel injection period Tinj is expressed by the following formula:

$$Tinj=TB.\ Kac.Ketc\pm Kacc/dec+TD$$

In the above formula, TB is a basic drive time (basic pulse injection width) of the injector 9, which is set from information on an inducted air quantity detected by the air flow sensor 17 and information on an engine speed Ne from the crank angle sensor 24. TD is a correction drive period which is added or subtracted to correct the drive period in accordance with a battery voltage from an unillustrated sensor.

Further, Ketc is a correction coefficient which includes therein elements other than the correction coefficient Kac. Kacc/dec is a correction coefficient corresponding to an acceleration or deceleration of the engine, and Kacc is added upon acceleration but Kdec is subtracted upon deceleration.

Incidentally, the correction coefficient Kac calculated by the above-described control data updating means 51 is updated only when all the following conditions are met:

A. The controlled state of operation of the engine is a lean-burn operation state, B. The idling switch 21 is off.

C. The state of operation of the engine 1 is a first operation state.

The term "first operation state" as used herein means an operation state in which the engine 1 remains in a detection data effective operation zone (hereinafter called the "X zone") shown in FIG. 4. This X zone is defined by the volumetric efficiency of the quantity of air inducted in the engine 1 and the revolution speed (i.e., engine speed). When the state of operation of the engine is found to satisfy all the following conditions 1 to 3 by operation state detection means (not shown) composed of the air flow sensor 17 and the crank angle sensor 24, the state of operation of the engine is determined to be within the X zone.

1. The engine speed Ne is within the range between two thresholds (XXZONNEL, XXZONNETH), namely, $XXZONNEL \leqq Ne \leqq XXZONNETH$.

2. The volumetric efficiency Ev of the quantity of inducted air is within the range between two thresholds (Ev-L,Ev-H), that is, $Ev\text{-}L \leqq Ev \leqq Ev\text{-}H$.

3. The shift lever of a transmission is in the D range (in the case of a vehicle equipped with an automatic transmission) or is at the 3rd speed or higher (in the case of a vehicle equipped with a manual transmission).

When these conditions are all met, the correction coefficient Kac is updated.

Such an X zone is set as will be described below.

Figures 6A, 6B, 6C:
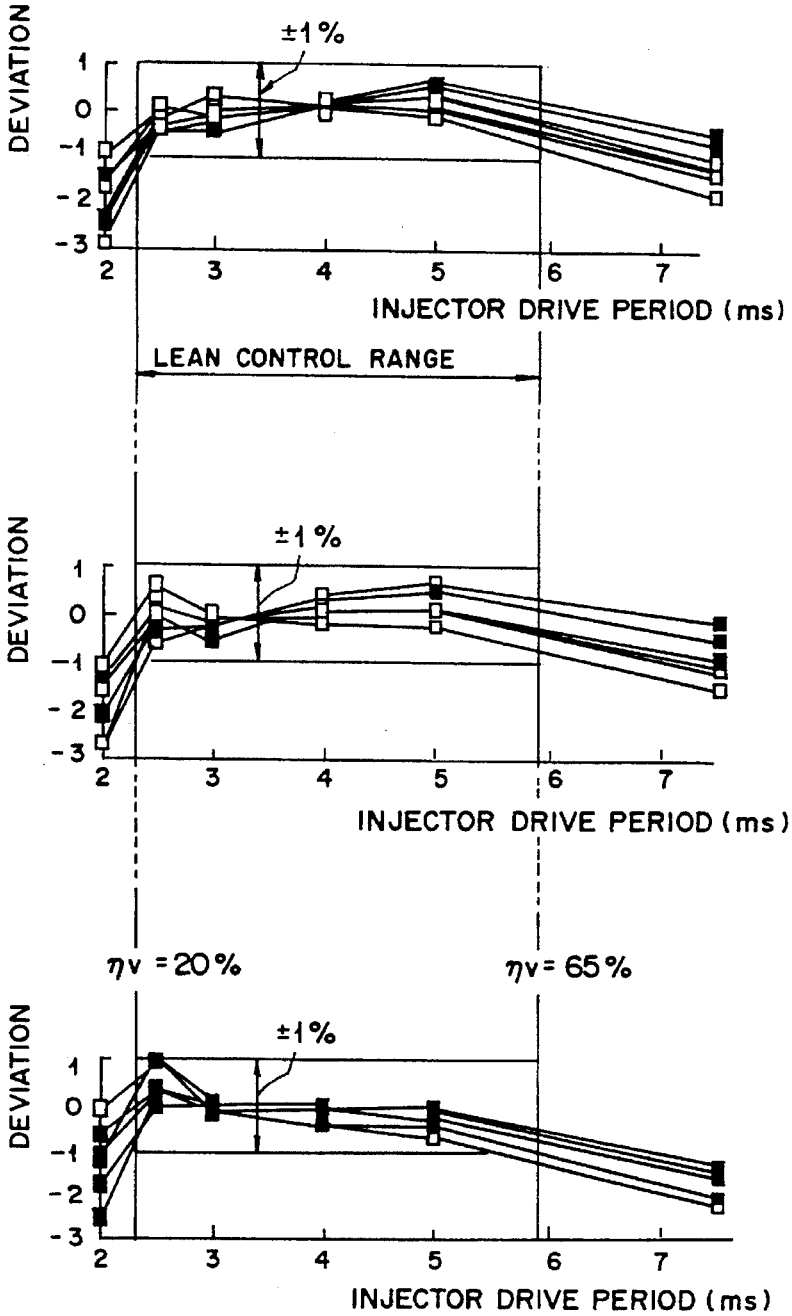
FIG. 6(*a*) through 6(*c*) diagrammatically illustrate operation characteristics of the fuel feeding system of the present invention for the internal combustion engine and show the relationships between the injector drive period of each injector mounted on a multi-cylinder engine and deviation, respectively.

For example, FIG. 6(*a*) through FIG. 6(*c*) are graphs all of which show the relationships between the drive period of each injector 9 mounted on a 6-cylinder engine and the deviation of flow rate inclination. They merely show different examples. As is indicated by these graphs, the linearity of operation of the injector deteriorates in regions where fuel is injected in small and large quantities, respectively. As the control of a combustion limit during a lean-burn operation, that is, the control of a combustion limit based on fluctuations of combustion while learning the fluctuations of combustion requires high accuracy, it is difficult to appropriately perform the control if the linearity of operation of the injector is low. Therefore, such regions are excluded and the lean-burn control is performed in such a region that the deviation of each injector 9 is limited within ±1% and the linearity of the injector is retained. This has made it possible to appropriately perform accurate correction of variations (i.e., control of a fuel limit for each cylinder). The X zone which is defined by the volumetric efficiency Ev and the engine speed Ne corresponds to this lean-burn control region in which the linearity of the injector is retained. This means that the learning region for performing a lean limit operation is limited to the inside of the X zone although the lean-burn operation itself is performed in a region greater than the X zone.

The volumetric efficiency Ev corresponds to the load of the engine 1. This engine load may vary depending on the manner of use of an electric system. Described specifically, an upward or downward fluctuation of the engine load (namely, the volumetric efficiency Ev) responsive to an ON/OF change-over of an air conditioner is relatively marked.

Figure 5:
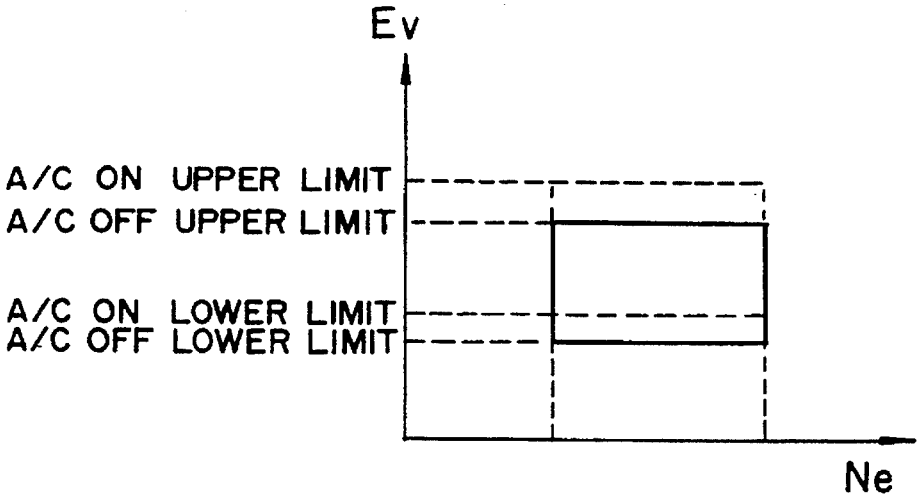
FIG. 5 is a map showing operation characteristics of the fuel feeding system of this invention for the internal combustion engine and depicting an illustrative change-over of the detection data effective operation zone.

In the system according to the present invention, the range of the X zone is therefore designed to be switchable as shown in FIG. 5 depending on whether the air conditioner is on or off. For example, the upper and lower thresholds Ev-H and Ev-L of the volumetric efficiency Ev of the quantity of inducted air are both changed over in FIG. 5 depending on whether the air conditioner is on or off.

Although the thresholds of the engine speed Ne are not changed in the above case, the thresholds of the engine speed Ne can be changed depending on whether the air conditioner is on or off. It is also possible to change both the thresholds of the volumetric efficiency Ev and those of the engine speed Ne.

By changing over the upper and lower thresholds Ev-H and Ev-L of the volumetric efficiency Ev of the quantity of inducted air depending on whether the air conditioner is on or off and hence changing over the scope of the X zone, very fine control of the combustion limit can be carried out.

ECU 25 is also provided with control data holding means 53 as illustrated in FIG. 1. If the operation region of the engine 1 departs from the X zone, the correction coefficient Kac as control data at the time of an operation in the X-zone before the departure is held, in other words, stored by the control data holding means 53.

Figure 4:
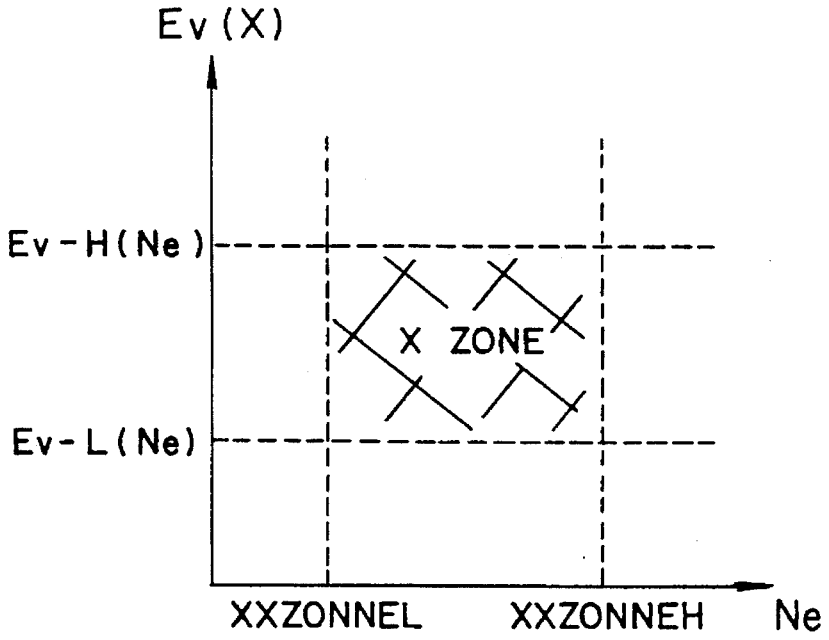
FIG. 4 is a map showing operation characteristics of the fuel feeding system of this invention for the internal combustion engine and depicting a detection data effective operation zone.

Operations outside this X zone (the first operation state) include the case that the state of operation of the engine 1 is a lean-burn operation state and is outside the X zone shown in FIG. 4 (this case will be called the "second operation state") and also the case that the engine 1 is in an operation state other than the lean-burn operation state (this case will be called the "third operation state"). In the second operation state, the correction means 52 correct the quantity of fuel, which is to be fed, by using the correction coefficient Kac held in the control data holding means 53. In the third operation state, on the other hand, an operation is performed by setting the air/fuel ratio at a value on a side richer than the lean air/fuel ratio.

The correction means 52 is provided with return time correction means 54 so that, when the engine 1 returns again to another lean-burn operation after departure from a lean-burn operation, the quantity of fuel to be fed during the lean-burn operation after the return is corrected by the correction coefficient Kac held in the control data holding means 53.

When the operation of the engine 1 again changes over to a lean-burn operation after the operation has returned to an operation state at an ordinary air/fuel ratio from the lean-burn operation, the fuel injection drive period is therefore set again using the correction coefficient which was learnt during the immediately preceding lean-burn operation. It is therefore unnecessary to learn variations among the cylinders from the beginning again, thereby making it possible to promptly move to a state where a lean-burn operation is controlled at the combustion limit.

ECU 25 is also provided with engine-stop-time control data holding means 55. This engine-stop-time control data holding means 55 holds control data (namely, the correction coefficient) at the time of the lean-burn operation even when the engine 1 is stopped. When the engine 1 is restarted and turns to a lean-burn operation state, the quantity of fuel which is to be fed during the lean-burn operation is promptly corrected by the correction coefficient Kac held in the engine-stop-time control data holding means 55.

In practice, the engine-stop-time control data holding means 55 is not arranged as a unit discrete from the control data holding means 53 but the control data holding means 53 is also used as the engine-stop time control data holding means 55. Namely, the control data holding means 53 continues to store the correction coefficient Kac even during stoppage of the engine while being backed up by the battery.

Even at a restart of the engine 1, the fuel injection drive period is therefore set using the correction coefficient learnt in the immediately preceding lean-burn operation. Accordingly, it is also possible to promptly move to the state of a lean-burn operation in which the combustion limit is controlled.

Where the correction coefficient Kac held in the control data holding means 53 is used, the correction coefficient Kac is clipped at a value equal to or greater than a predetermined value (for example, 1.0) to achieve a stable lean-burn operation.

Figure 7:
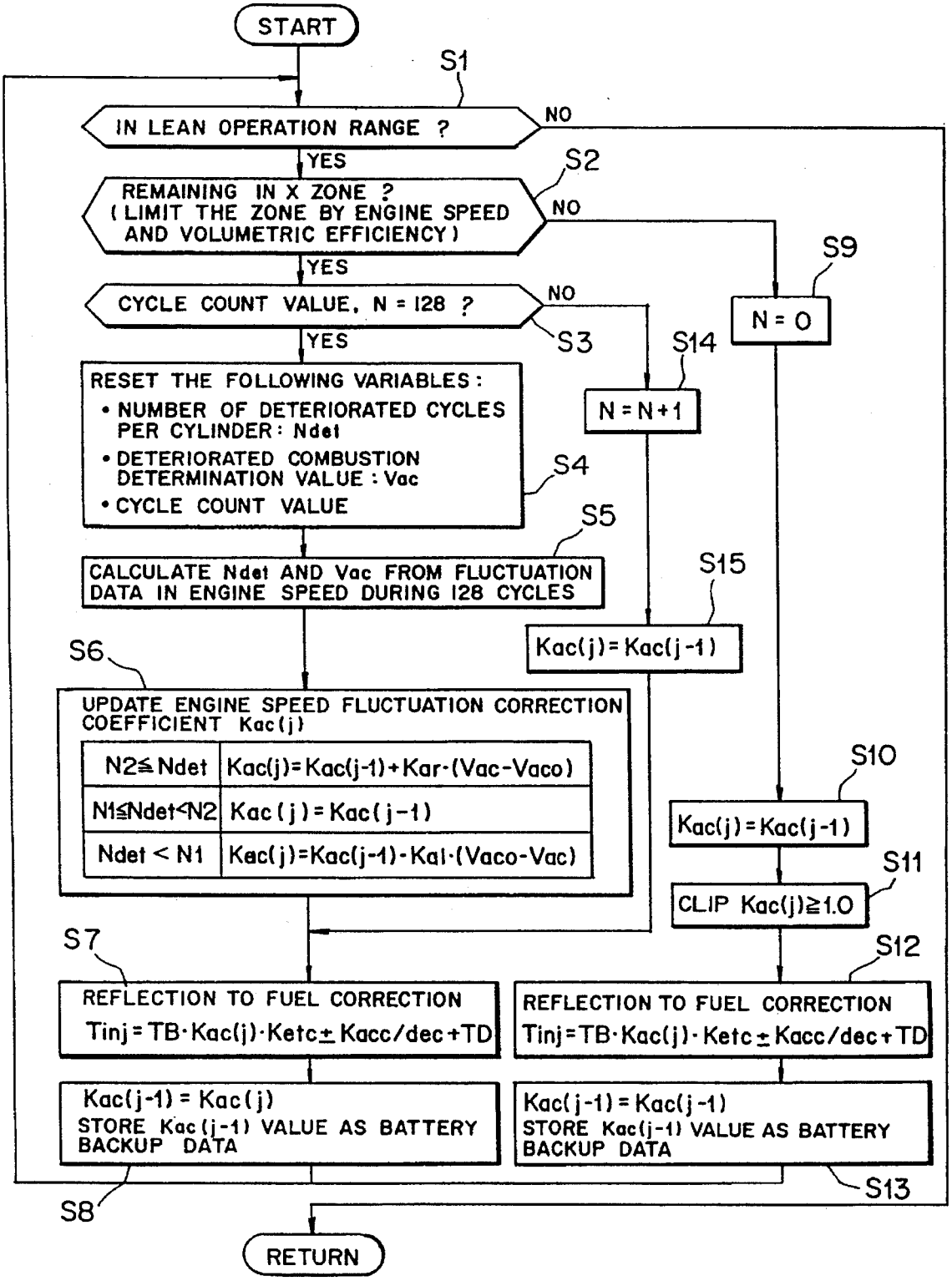
FIG. 7 is a flow chart for describing operation of the fuel feeding system of this invention for the internal combustion engine.

As the fuel feeding system according to the one embodiment of the present invention of the internal combustion engine is constructed as described above, correction of the quantity of fuel to be fed (namely, a fuel injection drive period) according to the fuel feeding method of another embodiment of the present invention for the internal combustion engine is performed, for example, through such procedures as shown in the flow chart of FIG. 7.

First, it is determined in step S1 whether or not the engine is in a lean-burn operation range. If the engine 1 is in the lean-burn operation range, the routine then advances step S2. Unless the engine 1 is in the lean-burn operation range, an operation is performed at a stoichiometric or rich air/fuel ratio.

In step S2, it is determined whether no not the operation state of the engine 1 is within the X zone depicted in FIG. 4. If the operation state of the engine 1 is determined to be within the X zone, the routine then advances to step S3. If the operation state of the engine 1 is outside the X zone, on the other hand, the routine advances to step S9 and the count value is set at 0 (N=0).

The routine further advances to step S10, where a correction coefficient Kac(j) is set equal to Kac(j−1) [Kac(j)=Kac(j−1)]. Kac(j) is then clipped at a predetermined value (1 in this case) in step S11. The routine then advances to step S12, where using the thus-clipped correction coefficient Kac(j), a fuel injection period is set in accordance with the following formula (correction step)

$$Tinj=TB.Kac.Ketc\pm Kacc/dec+TD$$

The routine then advances to step S13, where the stored value, Kac(j−1), of the preceding correction coefficient is changed to the stored value, Kac(j−1), of the present correction coefficient and the value of the correction coefficient Kac(j−1) is stored while being backed up by the battery.

When the routine advances from step S2 to S3, it is determined whether or not the number of control cycles has reached 128 cycles, in other words, leaning of fluctuations in combustion has been completed. Namely, it is determined in this step if the count value N is equal to 128 (N=128).

Until the count value N reaches 128, the count value is incremented by 1 (N=N+1). Then, Kac(j) is set equal to Kac(j−1) [Kac(j)=Kac(j−1)], and the routine next advances to step S7.

When the count value N has reached 128, the routine advances to step 4 so that the number Ndet of deteriorated cycles per cylinder, the deteriorated combustion determination value Vac and the cycle count value N are all reset.

The routine then advances to step S5 (combustion fluctuation detecting step), where the number Ndet of deteriorated cycles per cylinder and the deteriorated combustion determination value Vac are calculated according to data of revolutional fluctuations during the 128 cycles.

This combustion fluctuation detecting step comprises an angular acceleration fluctuation detection step, a normalized fluctuated value detection step and a deteriorated combustion information quantity detection step. In the angular acceleration fluctuation detecting step, an angular acceleration Acc is detected by the crank angle sensor 24 and, by determining the difference ΔAcc between a smoothed value AccAV obtained by smoothing the angular acceleration Acc and the angular acceleration Acc outputted from the crank angle sensor 24, an angular acceleration fluctuated value ΔAcc(n) corresponding to the state of a fluctuation of combustion in the engine 1 is detected. Incidentally, the acceleration fluctuated value ΔAcc(n) is calculated in accordance with the following formula:

$$\Delta Acc(n)=Acc(n)-AccAV(n)$$

AccAV(n) is in turn calculated by conducting a primary filtering processing in accordance with the following formula:

$$AccAV(n)=\alpha.AccAV(n-1)+(1-\alpha).Acc(n)$$

where α is an updating gain in the primary filtering processing.

In the normalized fluctuated value detection step, the fluctuated value ΔAcc(n) is normalized in accordance with the state of operation of the engine 1. Hence, the normalized fluctuated value IAC(n) is calculated in accordance with the following formula:

$$IAC(n)=\Delta Acc(n).Kte(Ev,Ne)$$

As is appreciated from the foregoing, the state of a fluctuation of combustion in the engine 1 is detected in the combustion fluctuation detecting step.

Next, in the deteriorated combustion information quantity detection step, a correction coefficient Kac which is required to make the state of combustion in the engine 1 approach a lean limit during a lean-burn operation is calculated based on plural detection data obtained in the combustion fluctuation detecting step.

In the control data updating step, the deteriorated combustion determination value Vac and the number Ndet(j) of deteriorated combustion cycles, which make up deteriorated combustion information quantities, are calculated for each cylinder in accordance with the following formulae:

$$Vac(j)=\Sigma\{IAC(j)<IACTH\}.\{IACTH-IAC(j)\}$$

$$Ndet(j)=\Sigma\{IAC(j)<IACTH\}$$

The deteriorated combustion determination value Vac(j) is obtained by cumulating each quantity of deterioration which indicates the difference between the threshold value IACTH and the normalized fluctuated value IAC(j), so that effects of values around the threshold can be minimized to precisely reflect the state of deterioration.

Based on these number Ndet(j) of deteriorated combustion cycles and deteriorated combustion determination value Vac, the correction coefficient Kac(j) is calculated in step S6 (control data updating step). Namely, by comparing the magnitude of the deteriorated cycle number Ndet(j) of a given cylinder with the two thresholds (N1,N2), the correction coefficient Kac is calculated by dividing the situation into the following three cases (1) to (3):

(1) When Ndet≦N2:

Kac(j)=Kac(j−1)+Kar(Vac-Vaco) (2) When N1≦Ndet<N2:

Kac(j)=Kac(j−1)

(3) When Ndet<N1:

Kac(j)=Kac(j−1)+Kal(Vac-Vac)

In step S7, the fuel injection period is set in accordance with the following formula (correction step).

$$Tinj=TB.Kac.Ketc\pm Kacc/dec+TD$$

The routine then advances to step S8 (control data holding step), where an updated value Kac(j) is set as a correction coefficient Kac(j−1) to be stored this time. The value of this correction coefficient Kac(j−1) is stored while being backed up by the battery. This step 8 is continued even during stoppage of the engine. In this case, step 8 corresponds to the engine-stop-time control data holding step.

Thereafter, the routine returns to step S1 and the same routine is repeated.

The deteriorated combustion determination value Vac(j) and the number Ndet(j) of deteriorated combustion cycles are updated for each cylinder at intervals of a preset number of combustions, for example, at every 128th (or 256th) cycle as described above. As the control is performed by ascertaining the state of combustion over a relatively long period, a stable and accurate correction reflecting statistical characteristics is conducted.

Further, the lower limit of the (Vac-Vaco) at the time of an enriching correction and that of the (Vaco-Vac) at the time of a leaning correction are both clipped at 0 upon computation.

The above-described correction coefficient Kac(j) is also designed to be clipped at both an upper limit and a lower limit. For example, it is set to fall within the range of from 0.9 to 1.1 (exclusive) [0.9<Kac(j)<1.1]. The correction coefficient Kac(j) is therefore set to avoid any abrupt correction and to gradually perform a correction so that occurrence of a shock or the like can be prevented and the control can be performed stably.

The correction coefficient Kac calculated in the above-described control data updating step is updated only when all the three conditions A to C have been met. Owing especially to the condition C, namely, the condition that the state of operation of the engine 1 is within the X zone shown in FIG. 4, the linearity of the injector is maintained and the correction coefficient Kac is updated based on fluctuation data of combustion under the conditions of good detection accuracy and control accuracy, whereby appropriate control is performed.

The present invention has been designed to permit change-over of the X zone by changing the setting of the scope of the X zone depending whether the air conditioner is on or off, that is, by switching the upper limit threshold Ev-H and the lower limit threshold Ev-L of the volumetric efficiency Ev of the quantity of inducted air depending on whether the air conditioner is on or off, very fine control of a combustion limit is feasible.

If the operation range of the engine 1 departs from the X zone, the correction coefficient Kac before this departure is held (stored) in the control data holding step. Needless to say, if the operation region of the engine departs from the lean-burn operation region, the correction coefficient Kac(j) obtained before this departure is likewise held.

When the state of operation of the engine 1 is a lean-burn operation state and is situated outside the X zone shown in FIG. 4, the quantity of fuel to be fed during the lean-burn operation is corrected in the correction step by using the correction coefficient Kac held in the control data holding step. As a result, the lean-burn operation can be controlled still more accurately at the combustion limit.

Accordingly, when the state of operation of the engine 1 returns again to a lean-burn operation after once departed from the state of an operation at an ordinary air/fuel ratio, the fuel injection drive period is set again using the correction coefficient which has been learnt during the immediately preceding lean-burn operation. It is therefore unnecessary to learn variations among cylinders again from the beginning, thereby making it possible to promptly move to a state where a lean-burn operation is controlled at the combustion limit.

During stoppage of the engine, the control data holding step also functions as an engine-stop-time control data holding step so that, even when the engine 1 is stopped, the correction coefficient at the time of the lean-burn operation is held. As a consequence, when the engine is restarted and its operation state becomes a lean-burn operation state, the quantity of fuel to be fed during the lean-burn operation is corrected by the correction coefficient Kac held in the 10 engine-stop-time control data holding step.

It is therefore still possible, even upon restarting the engine 1, to promptly move to a state in which a lean-burn operation is controlled at the combustion limit, because the fuel injection drive period is set using the correction coefficient leant during the immediately preceding lean-burn operation.

Upon conducting a correction by holding a correction coefficient as described above, the correction coefficient held in the control data holding step is clipped equal to or greater than a predetermined value (for example, 1.0) so that a stable lean-burn operation can be achieved.

According to the present invention, further advantages can also be brought about as will be described hereinafter. The present invention has made it possible to perform estimation of fluctuations in combustion while taking into consideration probabilistic characteristics of engine torque and also to conduct control of the air/fuel ratio based on this estimation. It is therefore possible to perform control of the state of combustion in the engine on a real time basis by an on-vehicle computer while taking into consideration probabilistic nature of fluctuations in combustion.

Further, it is also possible to surely correct differences in combustion limit among cylinders due to variations in air/fuel ratio which are caused by differences in the shapes of injectors and intake pipes and in valve timings. Therefore the individual cylinders can each be set at the combustion limit, thereby making it possible to minimize the emission of NOx.

Moreover, the detection and control of rotational fluctuations of the individual cylinders can be performed by only one crank angle sensor, whereby very accurate lean-burn control can be performed at low cost.

What is claimed is:

1. A fuel feeding system for an internal combustion engine, said system having fuel feeding means capable of controlling the quantity of fuel to be fed, means for detecting a fluctuated state of combustion in said internal combustion engine, and fuel feed control means for determining a quantity of fuel, which is to be fed from said fuel feeding means to maintain an air/fuel ratio of said internal combustion engine at a value in the neighborhood of a lean combustion limit, according to predetermined control data on the basis of detection data from said combustion fluctuation detecting means and controlling said fuel feeding means on the basis of the value of the thus-determined quantity of fuel, characterized in that said system further comprises:

means for detecting a state of operation of said internal combustion engine;

control data updating means for repeatedly updating the predetermined control data on the basis of the detection data when said internal combustion engine has been detected to be in a first operation state by said operation state detection means; and control data holding means for holding the control data at a value, to which the control data was updated dated in the immediately preceding first operation state, when said internal combustion engine has been detected to be out of the first operation state by said operation state detecting means.

2. A fuel feeding system according to claim 1, wherein said control data holding means comprises means for determining latest control data on the basis of control data updated immediately before and the detection data.

3. A fuel feeding system according to claim 1, wherein the first operation state is defined by a quantity of inducted air and a revolution speed of said internal combustion engine.

4. A fuel feeding system according to claim 1, wherein said system further comprises means for clipping the control data, which is held in said control data holding means, equal to or greater than a predetermined value which can achieve a stable lean-burn operation.

5. A fuel feeding system according to claim 1, wherein said system further comprises means for setting the air/fuel ratio on a side richer than the value in the neighborhood of the lean combustion limit in an operation state other than the first operation state.

6. A fuel feeding system according to claim 5, wherein said system further comprises means for determining the quantity of fuel, which is to be fed, on the basis of the control data held in the control data holding means when said internal combustion engine has returned again into the first operation state subsequent to departure from the first operation state.

7. A fuel feeding system according to claim 1, wherein said system further comprises means for setting, in an operation state other than the first operation state, the air/fuel ratio at a lean air/fuel ratio on the basis of the control date held in said control data holding means.

8. A fuel feeding system according to claim 7, wherein the first operation state is defined by a quantity of inducted air and a revolution speed of said internal combustion engine.

9. A fuel feeding system according to claim 7, wherein said system further comprises means for clipping the control data, which is held in said control data holding means, equal to or greater than a predetermined value which can achieve a stable lean-burn operation.

10. A fuel feeding system according to claim 1, wherein said system further comprises means for setting the air/fuel ratio at a lean air/fuel ratio on the basis of the held control data in a second operation state other than the first operation state but at an air/fuel ratio on a side richer than the lean air/fuel ratio in a third operation state other than the first operation state and the second operation state.

11. A fuel feeding system according to claim 10, wherein the first operation state is defined by a quantity of inducted air and a revolution speed of said internal combustion engine.

12. A fuel feeding system according to claim 10, wherein said system further comprises means for clipping the control data, which is held in said control data holding means, equal to or greater than a predetermined value which can achieve a stable lean-burn operation.

13. A fuel feeding system according to claim 1, wherein said data holding means comprises means for also holding the control data during stoppage of said internal combustion engine.

14. A fuel feeding system according to claim 1, wherein said internal combustion engine has plural cylinders; said plural cylinders are each provided with said combustion fluctuation detecting means, said control data updating means and said control data holding means; and said fuel feeding means comprises means for determining, on the basis of control data on the individual cylinders, quantities of fuel to be fed to the individual cylinders, respectively.

15. A fuel feeding system according to claim 1, wherein said combustion fluctuation detecting means comprises means for detecting as fluctuated combustion data of said internal combustion engine a fluctuated value in angular acceleration of a rotary shaft driven by said internal combustion engine and means for determining a normalized fluctuation value by normalizing the fluctuated value in accordance with a state of operation of said internal combustion engine; said system further comprises means for calculating a deteriorated combustion determination value by comparing the normalized fluctuation value, which has been obtained by said normalized fluctuation value determination means, with a predetermined threshold; said fuel feed control means further comprises means for modifying one of the fluctuated value and the threshold depending on the state of operation of said internal combustion engine; and said control data updating means comprises means for calculating the control data so that the deteriorated combustion determination value approaches a predetermined base value.

16. A fuel feeding method for an internal combustion engine, said method including determining a quantity of fuel, which is to be fed from fuel feeding means to maintain an air/fuel ratio of an internal combustion engine at a value in the neighborhood of a lean combustion limit, according to predetermined control data and controlling said fuel feeding means on the basis of the value of the thus-determined quantity of fuel, characterized in that said method comprises the following steps:

detecting a fluctuated combustion state of said internal combustion engine;

repeatedly updating the predetermined control data on the basis of the detection data in said fluctuated combustion state detection step when said internal combustion engine has been detected to be in a first operation state in said fluctuated combustion state detection step; and holding the control data at a value, to which the control data was updated in the immediately preceding first operation state, when said internal combustion engine has been detected to be out of the first operation state by said fluctuated combustion state detection step.

17. A fuel feeding method according to claim 16, wherein said control data updating step comprises determining latest control data on the basis of control data updated immediately before and the detection data.

18. A fuel feeding method according to claim 16, wherein the first operation state is defined by a quantity of inducted air and a revolution speed of said internal combustion engine.

19. A fuel feeding method according to claim 16, wherein said method further comprises clipping the control data, which is held in said control data holding step, equal to or greater than a predetermined value which can achieve a stable lean-burn operation.

20. A fuel feeding method according to claim 16, wherein said method further comprises setting the air/fuel ratio on a side richer than the value in the neighborhood of the lean combustion limit in an operation state other than the first operation state.

21. A fuel feeding method according to claim 20, wherein said method further comprises determining the quantity of fuel, which is to be fed, on the basis of the control data held in the control data holding step when said internal combustion engine has returned again into the first operation state subsequent to departure from the first operation state.

22. A fuel feeding method according to claim 21, wherein said method further comprises setting, in an operation state other than the first operation state, the air/fuel ratio at a lean air/fuel ratio on the basis of the control date held in said control data holding step.

23. A fuel feeding method according to claim 22, wherein the first operation state is defined by a quantity of inducted air and a revolution speed of said internal combustion engine.

24. A fuel feeding method according to claim 22, wherein said method further comprises clipping the control data, which is held in said control data holding step, equal to or greater than a predetermined value which can achieve a stable lean-burn operation.

25. A fuel feeding method according to claim 16, wherein said method further comprises setting the air/fuel ratio at a lean air/fuel ratio on the basis of the held control data in a second operation state other than the first operation state but at an air/fuel ratio on a side richer than the lean air/fuel ratio in a third operation state other than the first operation state and the second operation state.

26. A fuel feeding method according to claim 25, wherein the first operation state is defined by a quantity of inducted air and a revolution speed of said internal combustion engine.

27. A fuel feeding method according to claim 25, wherein said method further comprises clipping the control data, which is held in said control data holding step, equal to or greater than a predetermined value which can achieve a stable lean-burn operation.

28. A fuel feeding method according to claim 16, wherein said data holding step comprises also holding the control data during stoppage of said internal combustion engine.

29. A fuel feeding method according to claim 16, wherein said internal combustion engine has plural cylinders; and said fluctuated combustion state detection step, said control data updating step and said control data holding step are performed with respect to each of said plural cylinders, independently.

30. A fuel feeding method according to claim 16, wherein said fluctuated combustion state detecting step comprises an angular acceleration fluctuation detecting step for detecting as fluctuated combustion data of said internal combustion engine a fluctuated value in angular acceleration of a rotary shaft driven by said internal combustion engine and a normalized fluctuation value detection step for determining a normalized fluctuation value by normalizing the fluctuated value in accordance with a state of operation of said internal combustion engine; said method further comprises a deteriorated combustion determination value calculating step for calculating a deteriorated combustion determination value by comparing the normalized fluctuation value, which has been obtained in said normalized fluctuation value determination step, with a predetermined threshold and a step for modifying one of the fluctuated value and the threshold depending on the state of operation of said internal combustion engine; and said control data updating step comprises calculating the control data so that the deteriorated combustion determination value approaches a predetermined base value.

* * * * *